United States Patent [19]

Birke et al.

[11] 3,985,498

[45] Oct. 12, 1976

[54] PROCESS AND DEVICE FOR DRYING CHEMICAL PRODUCTS

[75] Inventors: Walter Birke; Hans-Ulrich von der Eltz; Franz Schon, all of Frankfurt am Main, Germany

[73] Assignee: Hoechst Aktiengesellschaft, Frankfurt am Main, Germany

[22] Filed: Oct. 24, 1974

[21] Appl. No.: 517,767

Related U.S. Application Data

[62] Division of Ser. No. 302,852, Nov. 1, 1972, abandoned.

[52] U.S. Cl. ..... 432/136; 432/65; 432/230

[51] Int. Cl.[2] ..... F27B 9/00; F27B 9/12; F26B 17/02

[58] Field of Search ..... 432/8, 59, 60, 227, 432/228, 230, 72, 58, 15, 136, 65; 34/115

[56] References Cited

UNITED STATES PATENTS

| | | | |
|---|---|---|---|
| 3,130,961 | 4/1964 | Varner et al. | 432/72 |
| 3,377,056 | 4/1968 | Boye | 432/60 |
| 3,542,501 | 11/1970 | Jones | 431/258 |
| 3,590,495 | 7/1971 | Tyson | 432/8 |
| 3,744,963 | 7/1973 | Flynn | 432/59 |
| 3,827,854 | 10/1973 | Gildersleeve | 432/8 |

*Primary Examiner*—John J. Camby
*Assistant Examiner*—Henry C. Yuen
*Attorney, Agent, or Firm*—Curtis, Morris & Safford

[57] ABSTRACT

An apparatus for drying a chemical product containing a burnable liquid by igniting and burning the liquid from the product, consisting of means for contacting the product with a burnable liquid, means for feeding the product and means for cooling the product and liquid to a temperature below the ignition temperature of the liquid, continuous conveyer means for transporting the product to a burning chamber, the burning chamber having inlet means for the product, combustion air inlet means, ignition means for igniting the burnable liquid and outlet means for hot combustion gases and outlet means for the dried product.

16 Claims, 1 Drawing Figure

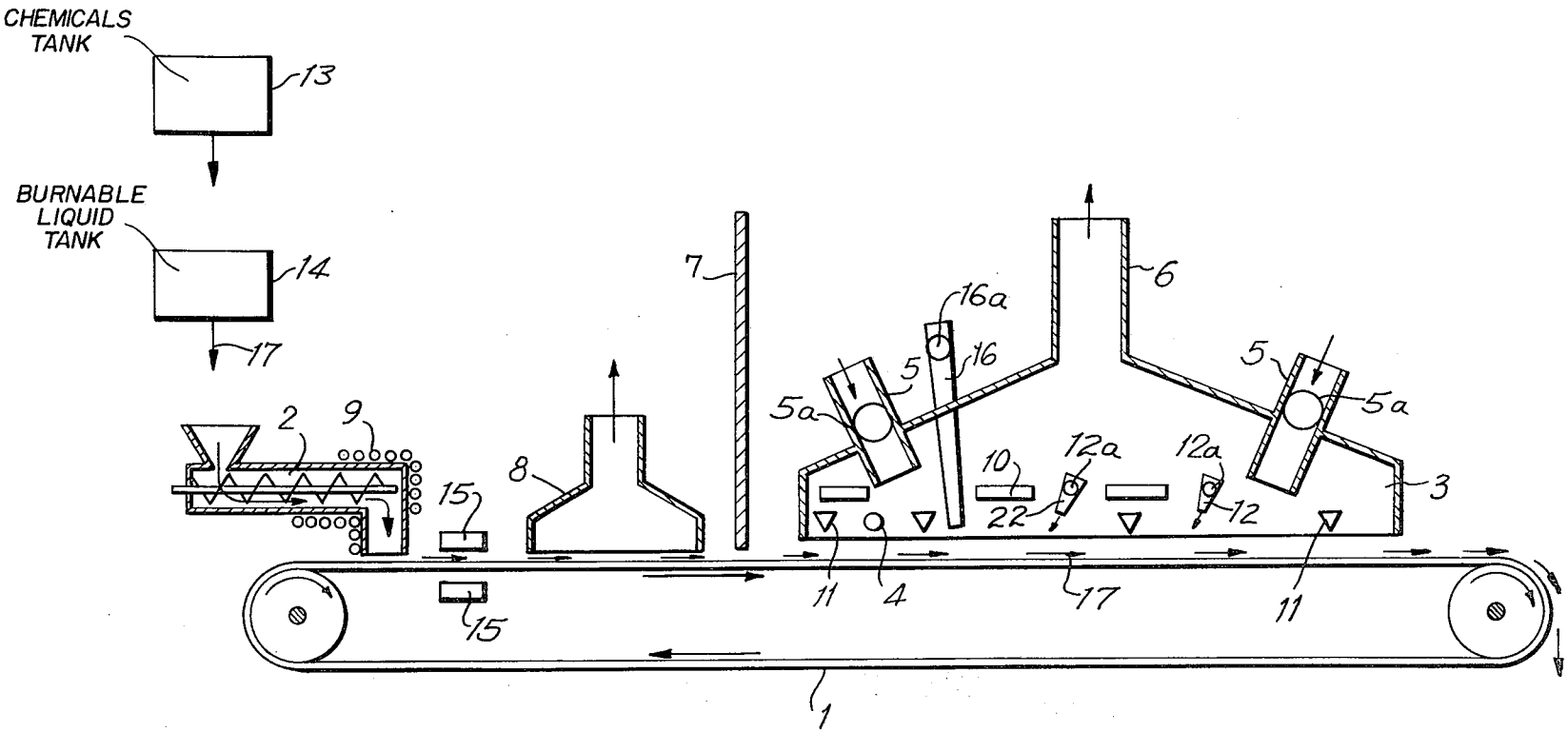
CHEMICALS TANK
BURNABLE LIQUID TANK
13
14
17
2
9
15
15
8
7
5a
5
16a
16
6
5a
5
3
11
12
12a
12a
17
10
22
4
11
1

PROCESS AND DEVICE FOR DRYING CHEMICAL PRODUCTS

This is a division, of application Ser. No. 302,852 filed Nov. 1, 1972, now abandoned.

The present invention relates to a apparatus for drying chemical products, in which the products are treated with a burnable liquid preferably methanol and this is subsequently burnt off.

According to the apparatus of the present invention it is possible to dry a number of chemical products, such as dyestuffs, pharmaceutical products or organic intermediates. Those substances are, by their nature, not suitable which, in combination with methanol, have undesired chemical reactions. Of special importance is the process for drying those substances which, when being prepared, are obtained in the form of methanolic solutions and suspensions or as press-cakes moist by methanol. In order to be able to control better the burning off process, it is often recommendable to work, not with pure methanol but with methanol/water mixtures, containing up to 70 % by volume, preferably 20 to 50 % by volume of water. That is to say that the necessary amount of methanol which, in the case of products which occur in the form of aqueous solutions or suspensions, can also be added subsequently, or the products can be isolated by filtering off, suction-filtering or squeezing off and the residue is washed out with methanol. As well as methanol, also other burnable organic solvents can be used separately or in mixture with methanol.

The products moistened with methanol or a methanol/water mixture are introduced into a suitable burning off device, where the methanol vapors are ignited by an igniting device and the products are dried completely in this way. By varying the water content the remaining moisture content may be controlled after drying. If pure methanol is used, for example at room temperature, or with addition of small amounts of water, it is sufficient to ignite the vapors once only. In the case of high water contents, that is if the ignition point is above room temperature, it is necessary to insure a continuous ignition, for example by several gas flames.

In the case of longer and above all continuous drying processes it is recommendable for reasons of safety to adjust the products to be dried before burning to temperatures of below the ignition point of the burnable liquid used. In general, temperatures of from 1° to 40° C, preferably 1° to 15° C, below the corresponding ignition point are sufficient. This can be brought about by cooling the products to be dried and/or by using liquids, for example methanol/water mixtures, the ignition points of which are above room temperature.

In the process claimed it has also been found that more advantageous results can be obtained, if the burning off process is effected in connection with drying systems already known, i.e., with additional supply of heat.

If the products to be dried are heated above the ignition point, for example by an infrared heating device or gas irradiators, in general, one ignition is sufficient. The ignition is expediently carried out in direct proximity to the heating device. Additional heating devices along the burning off area are also advantageous, if moist products are used which contain a high proportion of water.

The type of the burning off device depends to a large extent on the type and quantity of the product to be dried.

The chemicals to be dried can be obtained from a suitable source, e.g. tank 13 from which they are fed to means, e.g. tank 14 which applies a burnable liquid to the chemicals. The chemicals 17 containing the burnable liquid can then be fed to an apparatus including a burning chamber for burning off the liquid and drying the chemicals.

A device suitable for a continuous process to which the present invention refers, essentially consists of a conveyor belt, 1, on which the material to be dried is passed through a worm 2 or another suitable dosage device. This dosage device can expediently be equipped with a cooling device 9, which consists, for example, of cooling spirals. Furthermore, it is advantageous is further cooling elements 15 are available for cooling the conveyor belts. The material is transported on the conveyor belt into the burning off chamber 3, at the inlet opening of which the ignition device 4, for example an electric ignition element or a flame, is attached.

The openings 5 serve for supplying the burning air. The hot waste gases leave the burning off chamber by the outlet opening 6; they can be used for further heating purposes. In order to insure the safety of the equipment, a firm wall 7 and a ventilation device 8 are situated above the conveyor belt in front of the burning off chamber; through this ventilation device inflammable vapors are exhausted by suction from the room in front of the burning off chamber. By photo cells, thermo sensors or other controlling apparatuses the burning off process can be controlled; in this way controlling apparatuses, which are fixed either in front of or behind the ignition device, can regulate for example in the case of the running back flame the conveyor belt speed, influence the ignition device and different safety devices, as for example throttle or stop the supply of air by means **5*a* and, if desired, introduce instead of air, gases by means 16 and 16*a*** which are not burnable or do not maintain the burning off process.

Above the conveyor belt running in the drying chamber, there may be heating devices 10 which on one hand heat the burnable liquid above its ignition point and, on the other, promote the evaporation of the burnable liquid or of the water. Along the drying area controlling equipment 11 is attached for drying, regulating of the speed dependently of the burning area and for the safety equipment. For example air nozzles 12, and means **12*a*** also afixed on a swivel along the burning area, regulate the flame.

The FIGURE of the drawing illustrates an apparatus for drying solid chemical products in powder or granular form, containing a burnable liquid by igniting and burning the liquid from the products. This apparatus principally includes a burning chamber, the lateral walls of which may be open. Outside of the burning zone are arranged means for feeding the product to be dried and means for cooling the product and the burnable liquid to a temperature below the ignition point of the liquid. Before the inlet into the chamber a firm wall and suction means are provided to remove burnable liquid vapors from the product before it enters the burning zone. A continuous belt means is provided to transport the product by the suction means and through the burning zone. The burning zone chamber is equipped with means for igniting the burnable liquid, a combustion air inlet, an outlet for hot combustion, gases and an outlet for the dried product. Moreover there are further disposed within the chamber means for heating the burnable liquid and the product to be dried above ignition temperature of the burnable liquid, and means for controlling the burning temperature, drying, speed of the product and safety devices.

If solution or thin suspensions are to be dried, it is also possible to spray the solutions or suspensions in a tower, in which a flame ignites the methanol vapors.

The advantage of the process of the invention is that chemical products can be dried simply and, if desired, practically without expenditure of additional energy and that, especially when using methanol, no materials are produced by the burning off process which pollute air or water.

A concrete example for a device according to the invention is illustrated as side view in the drawing mentioned below.

EXAMPLE

The press cake washed with methanol, and which was obtained according to Example 1 of German Patent Specification No. 1 279 260 was spread out in an even thin layer on a tin and ignited at one place by a flame. After all the methanol had been burnt off and the flames extinguished, the dry dyestuff was obtained in a finely divided form.

We claim:

1. An apparatus for drying a chemical material containing a burnable liquid by igniting and burning the liquid from the material without harming or damaging the material, comprising a burning chamber having two opposing walls, two lateral walls and a top wall, one of said opposing walls having an inlet for the material to be dried and the other of said opposing walls having an outlet for the dried material, means disposed outside of the burning chamber and ahead of the material inlet and operably connected to the chamber for providing on the material a burnable liquid, ignition means mounted in said chamber adjacent to said material inlet for igniting the burnable liquid while on the material, means for maintaining burning of said liquid including combustion air inlet means mounted on said chamber and approximate to said chemical material inlet and directed towards said chemical material, said top wall having an outlet for hot combustion gases, and a continuous transport means disposed adjacent to and below said ignition means and operably connected to said chamber for transporting said material through said chamber.

2. The apparatus of claim 1 including suction means disposed outside of the burning chamber and ahead of the said chemical material inlet and operably connected to said transport means and to said burning chamber to remove burnable liquid vapors from the material before the material enters the chamber.

3. The apparatus of claim 1 wherein the combustion air inlet means is disposed in a lower portion of the burning chamber and the combustion gas outlet means is in the top wall of the burning chamber.

4. The apparatus of claim 1 comprising cooling means disposed approximate to and outside of said chemical material inlet and operably connected to the chamber for maintaining the burnable liquid prior to entering the chamber at a temperature below the ignition temperature of the burnable liquid.

5. The apparatus of claim 1 including control means mounted in the burning chamber and disposed adjacent to and spaced along the material to be dried and operably connected to said chamber for controlling the ignition means, burning flame, speed of the transport means and safety devices.

6. The apparatus of claim 1 including heating means mounted in the burning chamber and disposed approximate to and spaced along the material to be dried and operably connected to said burning chamber for heating the burnable liquid to a temperature above its ignition temperature.

7. The apparatus of claim 1 including flame control means mounted in the burning chamber and disposed adjacent to and spaced along the material to be dried, said flame control means comprising means for supplying air to the combustion flame.

8. The apparatus of claim 1 including flame control means mounted in the burning chamber and disposed adjacent to and spaced along the material to be dried, said flame control means comprising air supply nozzles wherein the direction of the nozzles may be varied.

9. The apparatus of claim 1 including safety means mounted on the burning chamber and disposed approximate to the material to be dried and operably connected to said chamber for supplying a non-burnable gas to said chamber capable of extinguishing the burnable liquid.

10. The apparatus of claim 1 including safety means mounted on said burning chamber and operably connected to said chamber for extinguishing the burnable liquid which comprises means for closing off the supply of combustion air to the burning chamber.

11. The apparatus of claim 1 in which the transport means comprises a continuous conveyor belt and drive means are provided for moving the belt and transporting the material through said chamber.

12. The apparatus of claim 1 wherein the material to be dried is a member selected from the group consisting of dyestuffs, pharmaceuticals and organic intermediates and the burnable liquid is a member selected from the group consisting of methanol and mixtures of methanol and water.

13. The apparatus of claim 1 wherein the cooling means is disposed outside and ahead of the burning chamber and consists of cooling coils arranged around the material feeding means.

14. An apparatus for drying a chemical material containing a burnable liquid by igniting and burning the liquid from the material without harming or damaging the material, comprising a burning chamber having two opposing walls, two lateral walls and a top wall, one of said opposing walls having an inlet for the material to be dried and the other of said opposing walls having an outlet for the dried material, means disposed outside of the burning chamber and ahead of the material inlet and operably connected to the chamber for providing on the material a burnable liquid, cooling means disposed approximate to and outside of the burning chamber material inlet and operably connected to the chamber for maintaining the burnable liquid prior to entering the chamber at a temperature below the ignition temperature of the burnable liquid, and ignition means mounted in said chamber adjacent to said material inlet for igniting the burnable liquid, combustion air inlet means mounted on said chamber and approximate to said chemical material and directed towards said chemical material, said top wall having an outlet for hot combustion gases, and a continuous transport means disposed adjacent to and below ignition means and operably connected to said chamber for transporting said material through said chamber.

15. The apparatus of claim 14 including suction means disposed outside of the burning chamber and ahead of said material inlet and operably connected to said transport means and to said burning chamber to remove burnable liquid vapors from the material before the material enters the chamber.

16. The apparatus of claim 14 wherein the material to be dried is a member selected from the group consisting of dyestuffs, pharmaceuticals and organic intermediates and the burnable liquid is a member selected from the group consisting of methanol and mixtures of methanol and water.

* * * * *

UNITED STATES PATENT AND TRADEMARK OFFICE

CERTIFICATE OF CORRECTION

PATENT NO. : 3,985,498

DATED : October 12, 1976

INVENTOR(S) : Walter Birke et al.

It is certified that error appears in the above-identified patent and that said Letters Patent are hereby corrected as shown below:

In the Heading, between Items [62] and [52], insert:

--[30] Foreign Application Priority Data

| | | |
|---|---|---|
| June 21, 1972 | Germany | P 22 30 236 |
| October 12, 1972 | Germany | P 22 49 932 |
| October 12, 1972 | Germany | P 22 50 005 -- |

Signed and Sealed this

Twenty-first Day of December 1976

[SEAL]

*Attest:*

RUTH C. MASON
*Attesting Officer*

C. MARSHALL DANN
*Commissioner of Patents and Trademarks*